US006069437A

United States Patent [19]

Matsuki et al.

[11] Patent Number: 6,069,437

[45] Date of Patent: May 30, 2000

[54] THERMAL DEFORMATION MEMBER FOR ELECTRON TUBE AND COLOR PICTURE TUBE USING THEREOF, AND THERMAL DEFORMATION MEMBER FOR ELECTRIC CURRENT CONTROL AND CIRCUIT BREAKER AND USING THEREOF

[75] Inventors: Toshiharu Matsuki, Yokohama; Satoru Habu, Fujisawa; Hitoshi Nakajima, Kobe, all of Japan

[73] Assignee: Kabushiki Kaisha Toshiba, Japan

[21] Appl. No.: 09/029,089

[22] PCT Filed: Jun. 19, 1997

[86] PCT No.: PCT/JP97/02101

§ 371 Date: Feb. 19, 1998

§ 102(e) Date: Feb. 19, 1998

[87] PCT Pub. No.: WO97/49110

PCT Pub. Date: Dec. 24, 1997

[30] Foreign Application Priority Data

Jun. 20, 1996 [JP] Japan ..... 8-160200

[51] Int. Cl.[7] ..... H01J 29/80

[52] U.S. Cl. ..... 313/407; 313/404; 313/402; 313/405

[58] Field of Search ..... 313/402, 405, 313/406, 407, 408, 404; 445/30; 428/619; 420/34, 63, 68, 70, 95, 96, 97, 109, 581

[56] References Cited

U.S. PATENT DOCUMENTS

| | | | |
|---|---|---|---|
| 3,838,985 | 10/1974 | Ornstein | 29/195.5 |
| 4,013,425 | 3/1977 | Mühlberger et al. | 29/195.1 |
| 4,041,432 | 8/1977 | Yarworth et al. | 337/111 |
| 4,115,624 | 9/1978 | Izbicki | 428/617 |
| 4,491,763 | 1/1985 | Fujinuma et al. | 313/405 |
| 5,086,251 | 2/1992 | Capek et al. | 313/408 |
| 5,502,350 | 3/1996 | Uehara et al. | 313/405 |

FOREIGN PATENT DOCUMENTS

| | | |
|---|---|---|
| 0 644 571 | 3/1995 | European Pat. Off. . |
| 29-3018 | 5/1954 | Japan . |
| 30-7824 | 10/1956 | Japan . |
| 33-3981 | 5/1958 | Japan . |
| 47-13209 | 7/1972 | Japan . |
| 52-4074 | 1/1977 | Japan . |
| 58-31380 | 7/1983 | Japan . |
| 63-2477 | 1/1988 | Japan . |
| 3-13889 | 1/1991 | Japan . |
| 7-169407 | 7/1995 | Japan . |
| 7-234292 | 9/1995 | Japan . |

*Primary Examiner*—Nimeshkumar D. Patel
*Assistant Examiner*—Joseph Williams
*Attorney, Agent, or Firm*—Finnegan, Henderson, Farabow, Garrett & Dunner, L.L.P.

[57] ABSTRACT

A high thermal expansion member consisting of such as an Fe—Ni—Cr based alloy, a low thermal expansion member consisting of such as an Fe—Ni based alloy, and an intermediary member, which comprises one kind of metal selected from Fe, Al and Cu or an alloy comprising these metals, possesses a thermal expansion coefficient $\alpha_3$ which is located between those of the high thermal expansion member (thermal expansion coefficient $\alpha_1$) and the low thermal expansion member (thermal expansion coefficient $\alpha_2$) ($\alpha_1>\alpha_3>\alpha_2$), and is interposed therebetween, are laminated to form a thermal deformation member for an electron tube or a thermal deformation member for electric control. The intermediary member, without adversely affecting strength or long term reliability of the thermal deformation member, contributes to manufacturing cost reduction and improvement of workability. In a color picture tube, the above described thermal deformation member for an electron tube is employed in a thermal deformation portion of a frame holder which one edge is solidly stuck to a panel and the other edge thereof is solidly stuck to a mask frame of a shadow mask. In an overcurrent protection, the above described thermal deformation member for electric current control is employed in a thermal deformation portion which opens a contact point.

15 Claims, 3 Drawing Sheets

THERMAL DEFORMATION MEMBER FOR ELECTRON TUBE AND COLOR PICTURE TUBE USING THEREOF, AND THERMAL DEFORMATION MEMBER FOR ELECTRIC CURRENT CONTROL AND CIRCUIT BREAKER AND USING THEREOF

TECHNICAL FIELD

The present invention relates to a thermal deformation member for an electron tube such as a color picture tube and the like and a color picture tube using thereof, and a thermal deformation member for an electric current control such as an overcurrent protection and the like and an overcurrent protection using thereof.

BACKGROUND ART

In a color picture tube using a shadow mask, the shadow mask, which has lots of fine holes transmitting an electron beam, is disposed in an opposite relation with respect to a phosphor layer formed inside a panel with a predetermined spacing. Surrounding an outer periphery of the shadow mask, a mask frame is fixed. A frame holder is disposed between the mask frame and the panel.

The electron beam that passes through the fine holes of the shadow mask is usually only about 20% of the total electron beam emitted from an electron gun. The remaining about 80% of the electron beam is absorbed by colliding with the shadow mask and the mask frame. When the shadow mask or the mask frame is thermally expanded by collision of the electron beam, the fine holes of the shadow mask and the dots formed in the phosphor layer are shifted in their relative positions to result in degradation of color purity.

Therefore, the shadow mask is generally formed of a low thermal expansion alloy such as an Fe—Ni based alloy and the like. Besides, the mask frame is conventionally formed of a generally used Fe based material from the view point of strength and the like. Therefore, in order to absorb thermal expansion of the mask frame, a spring material which is capable of deforming elastically is employed for a part of the frame holder.

In such a construction, since there is difference in the thermal expansions of the shadow mask and the mask frame when the electron beam is collided, absorption of the thermal expansion solely by the spring material is not enough to result in degradation of the color purity. Thus, a thermal deformation material which deforms in an opposite direction relative to the direction of thermal expansion of the mask frame is used for a part of the frame holder, aside from the spring material. For the thermal deformation member forming a part of such a frame holder, a so-called bimetal obtained by laminating a high thermal expansion member such as an Fe—Ni—Cr based alloy and a low thermal expansion member such as an Fe—Ni based alloy is conventionally used.

In addition, for over current protection, for example, use as a molded-case circuit-breaker and the like, a thermal deformation member is used to break overcurrent by opening a contact point. In the overcurrent protection, the thermal deformation member deforms due to its own Jule heat when the overcurrent flows. Otherwise, the overcurrent flows a resistor (heater) to induce a thermal deformation due to heating of the resistor. A circuit is broken due to deformation of the thermal deformation member. For the thermal deformation member for the over current protection, a 2-layered laminate material obtained by laminating a high thermal expansion member such as an Fe—Ni—Cr based alloy or an Fe—Ni—Mn based alloy and a low thermal expansion member such as an Fe—Ni based alloy, or an Fe—Ni—Co based alloy , or a 3 layered laminate material obtained by interposing Ni or a Cu—Zr alloy and the like as an intermedium is used.

In a bimetal using a high thermal expansion member such as an Fe—Ni—(Cr, Mn) based alloy and a low thermal expansion member such as an Fe—Ni based alloy, according to a required thermal deformation rate, a ratio between plate thicknesses of the high thermal expansion member and the low thermal expansion member is determined. Further, a total thickness of the laminate plate for securing material strength and long term reliability is determined. For example, for a bimetal for a color picture tube and the like, to make possible to secure the material strength and the long term reliability, a total plate thickness of 0.7 mm or more is required.

However, in the conventional bimetal, since the high Ni content alloys such as an Fe—Ni—(Cr,Mn) based alloy and an Fe—Ni based alloy are used for both of the high thermal expansion and low thermal expansion members, there is a problem that manufacturing cost is high. To reduce such a high manufacturing cost of the bimetal, it is considered to reduce concurrently the thicknesses of both of the high thermal expansion member and the low thermal expansion member. However, due to decrease of the total thickness of the bimetal, material strength and long term reliability as a thermal deformation members for both of a color picture tube and an overcurrent protection are deteriorated. Further, both of the Fe—Ni—(Cr,Mn) based alloy and the Fe—Ni based alloy are poor in its workability compared with a generally used Fe based alloy.

In addition, in Japanese Patent Laid-Open Application No. HEI 7-234292, a technology to interpose Ni, Ni alloy, a Zr—Cu alloy as an intermediary layer in order to adjust electric resistance of a bimetal which uses a high thermal expansion member consisting of the Fe—Ni—Cr based alloy and a low thermal expansion member consisting of the Fe—Ni based alloy is disclosed. Further, in Japanese Patent Laid-Open Application No. HEI 3-13889, a clad material which, though its high thermal expansion member is different, is obtained by cladding Cu, Ni, or an alloy formed therebetween as an intermediary member is disclosed. Further, Japanese Patent Laid-Open Application No. SHO 47-13209 discloses a technology in that, because its usage is different from the above described bimetal for a color picture tube, a high thermal expansion member such as a Mo—Cu—Ni based alloy is used for a composite thermostat material. In this patent application, it is disclosed that, in a composite thermostat material having a bimetal structure, various kinds of Fe alloys, which can be manufactured at a low cost compared with the outer side layer, can be used as an intermediary layer in the range that does not make inadequate resistance and flexibility of the composite material.

In sum, a bimetal having an intermediary layer for adjusting electric resistance and a composite thermostat material of bimetal structure having low cost Fe alloy as an intermediary layer were already proposed. However, in a field of the thermal deformation member used for a color picture tube and an overcurrent protection, no satisfactory proposal has been made reduce costs, while satisfying requirement of adequate bent coefficient.

An objective of the present invention is to provide a thermal deformation member for an electron tube for which manufacturing cost is reduced and workability is improved without adversely affecting its strength and long term reliability, and a color picture tube using thereof. Another objective of the present invention is, without adversely affecting its strength and long term reliability, to provide a thermal deformation member for an electric current control for which manufacturing cost is reduced and workability is improved, and an overcurrent protection using thereof.

DISCLOSURE OF INVENTION

A thermal deformation member for an electron tube of the present invention comprises the first member of thermal expansion coefficient $\alpha_1$, the second member of thermal expansion coefficient $\alpha_2$ different from that of the first member, and an intermediary member which is interposed between the first member and the second member and possesses thermal expansion coefficient of $\alpha_3$ satisfying relationship of $\alpha_1>\alpha_3>\alpha_2$, wherein the first member, the intermediary member, and the second member are laminated.

A more specific thermal deformation member for an electron tube of the present invention comprises a high thermal expansion member such as an Fe—Ni—Cr based alloy, a low thermal expansion member such as an Fe—Ni based alloy, and an intermediary member which is interposed between the high thermal expansion member and the low thermal expansion member and is composed of one kind of metal selected from a group of Fe, Al, and Cu, or an alloy including these metals, wherein the high thermal expansion member, the low thermal expansion member, and the intermediary member are laminated.

A color picture tube of the present invention comprises an electron gun irradiating an electron beam, a panel having a phosphor layer to which the electron beam irradiated from the electron gun collides, a shadow mask disposed in an opposite relation with respect to the phosphor layer with a predetermined spacing and possessing a lot of fine holes which transmit the electron beam, a mask frame fixed to the shadow mask, a thermal deformation portion formed of the thermal deformation member for an electron tube of the present invention and an elastic portion, and a frame holder one edge thereof being fixed to the panel and the other edge thereof being fixed to the frame holder.

Further, a thermal deformation member for an electric current control of the present invention comprises the first member possessing thermal expansion coefficient $\alpha_1$, the second member possessing thermal expansion coefficient $\alpha_2$ different from that of the first member, and an intermediary member interposed between the first member and the second member and possessing thermal expansion coefficient $\alpha_3$ satisfying relationship of $\alpha_1>\alpha_3>\alpha_2$, wherein the first member, the intermediate member, and the second member are laminated.

A more specific thermal deformation member for electric current control of the present invention comprises a high thermal expansion member composed of an Fe—Ni—(Cr, Mn) based alloy, a low thermal expansion member composed of an Fe—Ni based alloy, and an intermediary member interposed between the high thermal expansion member and the low thermal expansion member and composed of one kind of metal selected from a group of Fe, Al, and Cu, or an alloy including the above mentioned metals, wherein the high thermal expansion member, the intermediate member and the low thermal expansion member are laminated.

An overcurrent protection of the present invention comprises a thermal deformation portion consisting of a thermal deformation member for an electric current control of the above described present invention which, when overcurrent flows, deforms due to its own Joule heat, or due to heat generated by resistor disposed in contact, and a contact point which opens circuit according to the deformation of the thermal deformation portion.

In a thermal deformation member for an electron tube and a thermal deformation member for an electric current control both of the present invention, since the intermediary member possesses the thermal expansion coefficient located between those of a high thermal expansion member and a low thermal expansion member, thermal deformation and the like as a thermal deformation member can be determined depending on the thermal expansion coefficients of the high expansion member and the low expansion member and plate thickness ratio therebetween. Therefore, by adopting a member less expensive and excellent in their workability as an intermediary member, thermal deformation degree to be aimed can be obtained and the total plate thickness which influences strength and long term reliability can be secured. In addition, the plate thickness of both of the high thermal expansion member and the low thermal expansion member can be reduced by the identical thickness as that of the intermediary member. Thereby, the manufacturing cost of the thermal deformation member for an electron tube and the thermal deformation member for an electric current control can be reduced as a whole and, further, the workability can be improved.

The thermal deformation portion of the frame holder of a color picture tube of the present invention is constructed with the above described thermal deformation member for an electron tube. Therefore, even when the shadow mask or the mask frame are thermally expanded, while preventing deterioration of color purity accompanying displacement of relative position between the phosphor layer formed inside the panel and the fine holes of the shadow mask or the slit, reduction of the manufacturing cost can be made possible. Further, the overcurrent protection of the present invention, while securing protection property of the circuit due to the occurrence of the overcurrent such as over load current or short-circuit current, still attains reduction of the manufacturing cost.

BEST MODE FOR CARRYING OUT THE INVENTION

In the following, embodiments for implementing the present invention will be explained.

Figure 1:
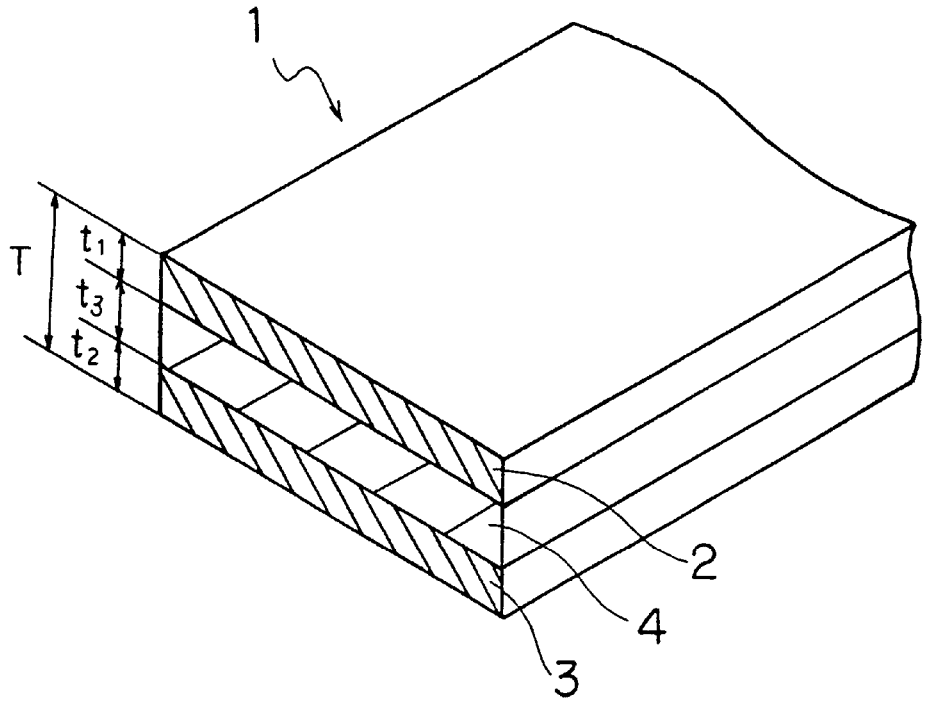
FIG. 1 is a perspective view showing a construction of one embodiment of a thermal deformation member for an electron tube of the present invention.

FIG. 1 is a perspective view showing one embodiment of a thermal deformation member for an electron tube of the present invention. The thermal deformation member for an electron tube 1 shown in FIG. 1 comprises the first member and the second member contributing to fundamental property of thermal deformation such as thermal bent, that is, a high thermal expansion member 2 and a low thermal expansion member 3. Here, the high thermal expansion member 2 and the low thermal expansion member 3 can just as well be relatively different in their thermal expansion coefficient and are not necessarily restricted to absolute values of their thermal expansion coefficients.

Although the high thermal expansion member 2 and the low thermal expansion member 3 are not particularly restricted in their material as described above, since a large thermal bent curvature (bent coefficient) can be obtained, an Fe—Ni—Cr based alloy and an Fe—Ni based alloy are preferably employed as the high thermal expansion member 2 and the low thermal expansion member 3, respectively. The plate thickness ratio ($t_1$:$t_2$) of the high thermal expansion member 2 (plate thickness $t_1$) and the low thermal expansion member 3 (plate thickness $t_2$) is determined according to the desired thermal bent curvature. For example, in a thermal deformation member (bimetal) 1 for a color picture tube employing an above described alloy, the plate thickness ratio $t_1$:$t_2$ is preferable to be set in the range of from 55:45 to 45:55.

As an Fe—Ni—Cr based alloy employed for the high thermal expansion member 2, an alloy comprising from 15 to 30 weight % of Ni, from 2 to 10 weight % of Cr, and the balance essentially consisting of Fe can be cited. When the addition quantity of Ni and Cr is outside the above described range, both cases lead to lowering of the thermal expansion coefficient. Further, as an Fe—Ni based alloy for the low thermal expansion member 3, an alloy containing from 30 to 50 weight % of Ni and the balance essentially consisting of Fe can be cited. When the Ni content is either below 30 weight % or over 50 weight %, the thermal expansion coefficient becomes large. That is, in the range of from 30 to 50 weight % of Ni content, good thermal expansion can be obtained.

Between the above described high thermal expansion member 2 and the low thermal expansion member 3, the intermediary member 4 is interposed, the intermediary member 4 possessing an intermediate thermal expansion coefficient $\alpha_3$ ($\alpha_1>\alpha_3>\alpha_2$) located between the thermal expansion coefficient $\alpha_1$ of the high thermal expansion member 2 and the thermal expansion coefficient $\alpha_2$ of the low thermal expansion member 3. By laminating and sticking these each layer 2, 3, 4, the thermal deformation member for an electron tube 1 is formed. The thermal deformation member for an electron tube 1 can be said to be a bimetal consisting of a clad material of 3 layered structure (3 layer laminated member). For laminating these each layer 2, 3, 4, the generally used cladding method can be employed. Specifically, each layer 2, 3, 4 can be respectively joined together by, for example, hot rolling.

The plate thickness $t_3$ of the intermediary member 4, basically, can be appropriately determined in the range of the total thickness T which is required for securing strength or long term reliability of the thermal deformation member for an electron tube 1. However, since the thermal deformation of the high thermal expansion member 2 and the low thermal expansion member 3, in particular, the thermal deformation of the high thermal expansion member 2 tends practically to deteriorate under restriction of the intermediate member 4, it is preferable that the plate thickness $t_3$ of the intermediate member 4 is below 80% of the total plate thickness T. This thickness can vary according to the constituent materials of each layer 2, 3, 4. In addition, if the thermal expansion coefficient $\alpha_3$ of the intermediary member 4 is close to either one of thermal expansion coefficients $\alpha_1$, $\alpha_2$ of the high thermal expansion member 2 and the low thermal expansion member 3, by reducing the plate thickness of the member (2 or 3) the thermal expansion coefficient of which is close to this thermal expansion coefficient, the thermal bent curvature of the thermal deformation member for an electron tube 1 can be made to be set at the desired one.

The specific material of the intermediate member 4 can be appropriately selected considering the material of the high thermal expansion member 2 and the low thermal expansion member 3. For example, when an Fe—Ni—Cr based alloy is used for the high thermal expansion member 2 and an Fe—Ni based alloy is used for the low thermal expansion member 3, it is preferable to use one kind of metal selected from Fe, Al, and Cu or an alloy including these metals as the intermediate member 4, wherein Fe, Al, and Cu are excellent in workability and less expensive than these alloys. For the constituent material of the intermediate member 4, from the view point of the thermal bent property and the workability, Fe, Al or an alloy containing these metals as base can be preferably used. In particular, steel can be said a desirable material effective in manufacturing cost reduction. As the steel to be used for the intermediate member 4, steel material SS 400 (SS 400 as defined in JIS G 3101) comprising 0.3 weight % or less of C, 0.05 weight % or less of P, 0.05 weight % or less of S, and the balance of Fe with inevitable impurities can be cited.

Now, since the intermediate member 4 possesses the thermal expansion coefficient $\alpha_3$ placed between those of the high thermal expansion member 2 ($\alpha_1$) and the low thermal expansion member 3 ($\alpha_2$), the thermal bent curvature of the thermal deformation member for an electron tube 1 can be determined by the thermal expansion coefficients $\alpha_1$, $\alpha_2$ of the high thermal expansion member 2 and the low thermal expansion member 3, and the plate thickness ratio ($t_1$:$t_2$) between the plate thicknesses of these members. Therefore, if the plate thickness ratio ($t_1'$: $t_2'$) of the high thermal expansion member 2 and the low thermal expansion member 3 of a conventional bimetal, for example, shown in FIG. 2, and the plate thickness ratio ($t_1$:$t_2$) of the high thermal expansion member 2 and the low thermal expansion member 3 of the thermal deformation member for an electron tube 1 according to the present embodiment are identical, nearly equal level of the bent curvature can be obtained.

Figure 2:
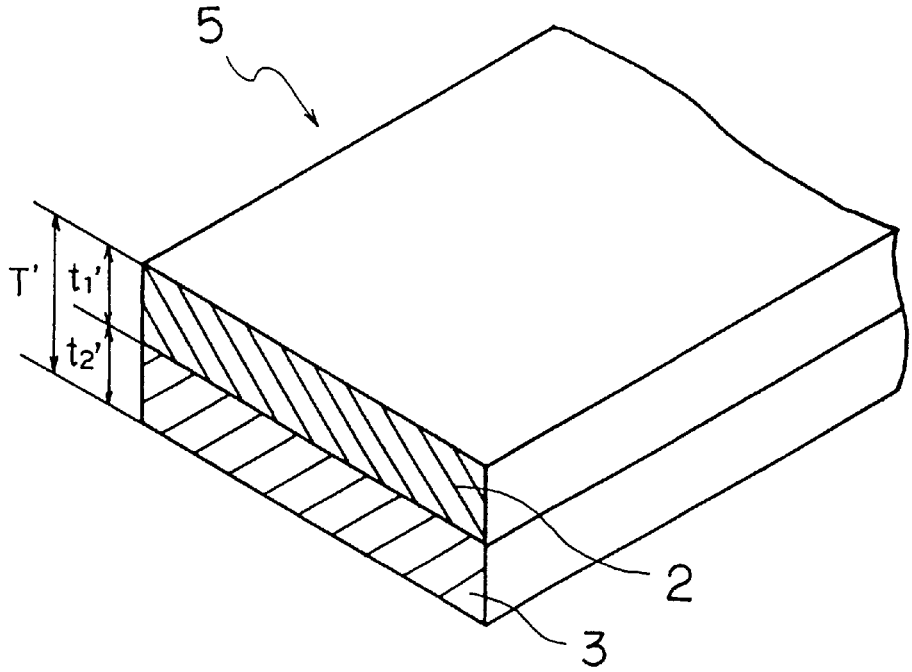
FIG. 2 is a perspective view showing a construction of a conventional bimetal.

Now, in the conventional bimetal 5 shown in FIG. 2, the total plate thickness T' has to be secured by the plate thickness $t_1'$ of the high thermal expansion member 2 and the plate thickness $t_2'$ of the low thermal expansion member 3. On the contrary, in the thermal deformation member for an electron tube 1 of the present invention shown in FIG. 1, the plate thicknesses $t_1$, $t_2$ of the high thermal expansion member 2 and the low thermal expansion member 3 can be reduced by the plate thickness $t_3$ of the intermediate member 4. Even after reduction of these plate thicknesses, the thermal deformation member for an electron tube 1 of the present invention has a nearly identical thermal bent curvature as the conventional bimetal 5 does. In other words, while reducing the plate thicknesses $t_1$, $t_2$ of the high thermal expansion member 2 and the low thermal expansion member 3 and attaining nearly equal thermal bent curvature, the total plate thickness T required for strength or the long term reliability can be secured.

Bent coefficients of several specific examples of the above described thermal deformation member for an electron tube 1 are shown in Table 1. In each specific example, an Fe-22 weight % Ni-4.5 weight % Cr alloy and an Fe-36 weight % Ni alloy are used for the high thermal expansion member 2 and for the low thermal expansion member 3, respectively. For the intermediary member 4, steel material SS 400 of various plate thicknesses are used. The plate thickness ratio between the high thermal expansion member 2 and the low thermal expansion member 3 was set at 1:1 and the total plate thickness T of the thermal deformation member for an electron tube 1 was 2.5 mm. A comparative example shown in Table 1 is for the conventional bimetal 5 (bimetal for a color picture tube) shown in FIG. 2. In the comparative example, constituent material of the high thermal expansion member 2 and the low thermal expansion member 3, the plate thickness ratio therebetween, and the total plate thickness T' were set identical as the above described embodiments.

TABLE 1

| | Embodiment 1 | Embodiment 2 | Embodiment 3 | Comparative Example |
|---|---|---|---|---|
| Plate Thickness Constitution Ratio (%) of Intermediary Member (steel) | 30 | 50 | 60 | — |
| Bent Coefficient ($\times 10^6$ /K) | 14.0 | 13.5 | 11.3 | 14.2 |

As evident from Table 1, in each embodiment, as the constitutional ratio of the intermediate member 4 formed of the steel material SS 400 becomes large, the bent curvature decreases. However, if the plate thickness constitutional ratio of the intermediate member 4 is about 60%, it can be understood that the thermal deformation member for an electron tube 1 of the above described constitution can be satisfactorily used for the bimetal of a color picture tube. Compared with the Fe-22 weight % Ni-4.5 weight % Cr alloy or the Fe-36 weight % Ni alloy, the cost of the steel material is about one fourth. Therefore, when compared with the conventional bimetal 5, the manufacturing cost of the thermal deformation member for an electron tube 1 of each embodiment can be reduced in total by about 30–40%. Further, the steel material is excellent in its workability compared with that of the Fe-22 weight % Ni-4.5 weight % Cr alloy or the Fe-36 weight % Ni alloy. Therefore, the thermal deformation member for an electron tube 1 of each embodiment can be improved in its workability compared with that of the conventional bimetal 5.

As described above, in the thermal deformation member for an electron tube 1 of the embodiments, the total plate thickness T which affects the desired thermal bent curvature and strength or long term reliability can be obtained while reducing the plate thicknesses $t_1$, $t_2$ of the high thermal expansion member 2 and the low thermal expansion member 3. Therefore, when the Fe—Ni—Cr based alloy or the Fe—Ni based alloy which are expensive in the manufacturing cost and inferior in the workability are used for the high thermal expansion member 2 and the low thermal expansion member 3, by disposing the intermediate member 4 which is less expensive and superior in its workability to those, while obtaining the desired thermal bent curvature, the manufacturing cost of the thermal deformation member for an electron tube 1 can be reduced as a whole and its workability can be enhanced.

Next, one embodiment of a color picture tube of the present invention will be explained with reference to FIG. 3 and FIG. 4.

Figure 3:
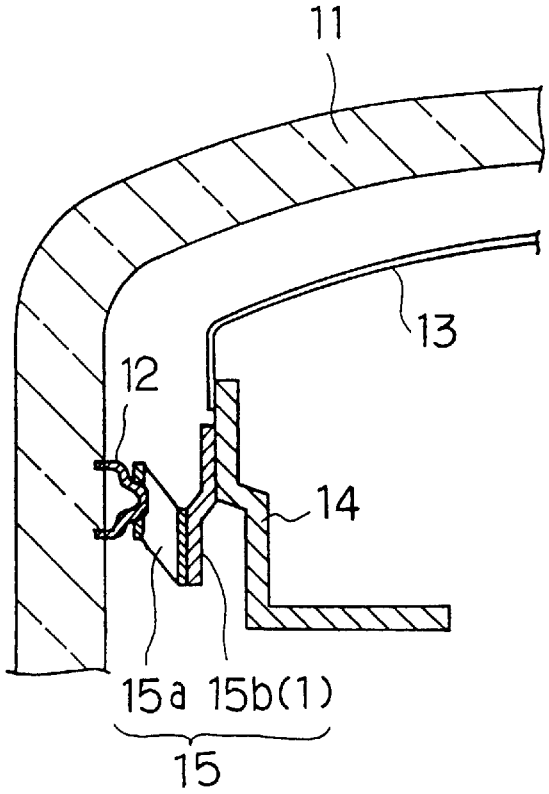
FIG. 3 is a sectional view showing an essential construction of a color picture tube according to one embodiment of the present invention.
Figure 4:
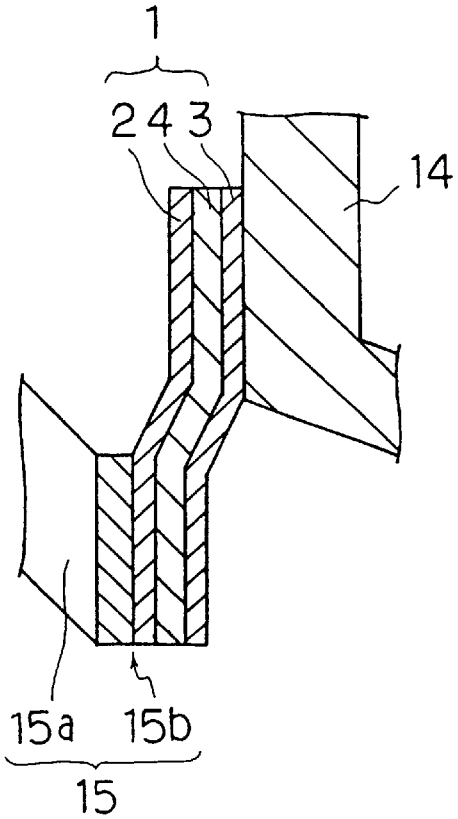
FIG. 4 is a diagram showing enlargement of the essential portion of the color picture tube shown in FIG. 3.

FIG. 3 is a sectional view showing a construction of an essential portion of a color picture tube according to one embodiment of the present invention. In the figure, numeral 11 shows a panel inside which a not shown phosphor layer is formed. Along an inner circumference surface in the neighborhood of an opening of the panel 11, a panel pin 12 is disposed. Inside the panel 11, a shadow mask 13 is disposed in an opposite relation with respect to the phosphor layer formed inside the panel with a predetermined spacing.

In the shadow mask 13, many fine holes or slits not shown in the figure are formed and an electron beam past through these fine holes or slits collides with the phosphor layer. An electron beam is irradiated from an electron gun not shown in the figure. The electron gun is disposed inside a neck (not shown) connected to the panel 11 through a funnel (not shown).

The shadow mask 13 is formed of a low thermal expansion alloy such as an Fe—Ni based alloy. At the outer periphery portion of the shadow mask 13, a mask frame 14 consisting of Fe based material such as the steel material and the like is fixed. To the mask frame 14, one edge of a frame holder 15 is fixed and the other edge portion of the frame holder 15 is fixed in an engaging manner to the panel pin 12. Thus, the shadow mask 13 is elastically supported by the panel 11 through the frame holder 15.

The above described frame holder 15 has an elastic portion 15*a* consisting of such as a stainless spring material and a thermal deformation portion 15*b* comprising the thermal deformation member for an electron tube 1 of the present invention which is explained in the above described embodiments. The elastic portion 15*a* is disposed on the panel 11 side and, when the shadow mask 13 or the mask frame 14 is expanded thermally, its spring property (elasticity) can absorb this expansion effect. Besides, the thermal deformation portion 15*b*, as shown in FIG. 4 in enlarged manner, is constituted by disposing the thermal deformation member for an electron tube 1 in such a manner that the low thermal expansion member 3 of the thermal deformation member for an electron tube 1 is placed on the mask frame 14 side and the high thermal expansion member 2 is placed on the panel 11 side through the intermediate member 4. That is, when the shadow mask 13 or the mask frame 14 is expanded thermally, the thermal deformation portion 15*b* deforms in an opposite direction to that of the thermal expansion.

When the thermal expansion coefficients of the shadow mask 13 and the mask frame 14 are different, even if these are expanded thermally by collision of an electron beam, through the frame holder 15 possessing the elastic portion 15*a* and the thermal deformation portion 15*b*, relative position between the dots of the phosphor layer formed inside the panel 11 and the fine holes or the slits of the shadow mask 13 can be prevented from dislocating. Further, this dislocation prevention, as explained in the above described embodiments, is materialized by the thermal deformation member for an electron tube 1 of the present invention which is less expensive and excellent in workability compared with the conventional bimetal and can secure the total plate thickness which influences strength or long term reliability. Therefore, in addition to realization of the manufacturing cost reduction of a color picture tube, reliability of a color picture tube can be enhanced accompanying the improvement of its workability.

Next, an embodiment of a thermal deformation member for an electric current control of the present invention will be explained.

Figure 5:
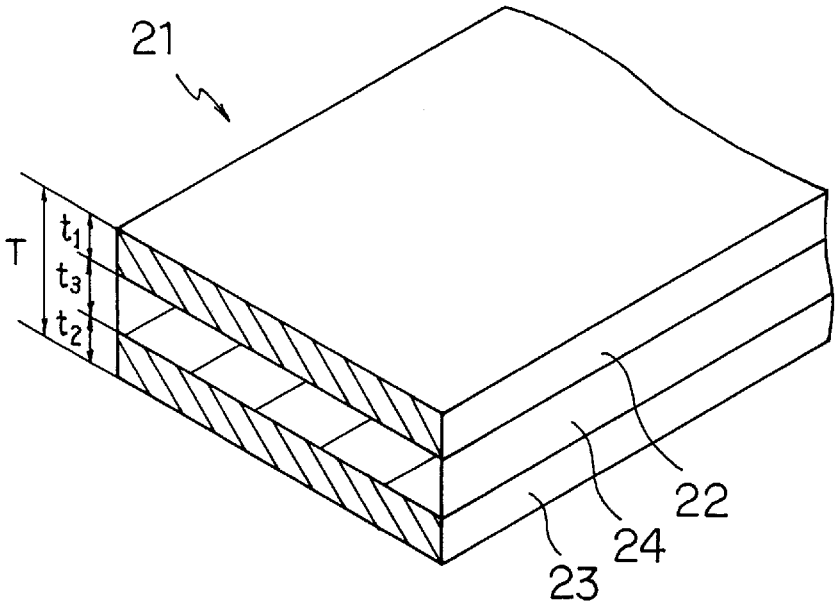
FIG. 5 is a perspective view showing a construction of one embodiment of a thermal deformation member for an electric current protection of the present invention.

FIG. 5 is a perspective view showing one embodiment of a thermal deformation member for an electric current control of the present invention. A thermal deformation member for an electric current control 21 shown in the figure possesses, as identical as the above described thermal deformation member for an electron tube 1, a high thermal expansion member (thermal expansion coefficient $\alpha_1$) 22 and a low thermal expansion member (thermal expansion coefficient $\alpha_2$) 23 contributing fundamental property of thermal deformation, and an intermediate member 24 possessing an intermediate thermal expansion coefficient $\alpha_3$ ($\alpha_1>\alpha_3>\alpha_2>$) and disposed therebetween. By laminating and sticking each layer 22, 23, 24 to one another, a thermal deformation member for an electric current control 21 formed of a 3 layered clad material can be constructed.

Lamination between these each of layers 22, 23, 24, a plate thickness ratio ($t_1$:$t_2$) between the high thermal expansion member 22 and the low thermal expansion member 23, and a plate thickness $t_3$ of the intermediate member 24 (ratio to total plate thickness T) and the like are preferable to be set identical as the case of the above described thermal deformation member for an electron tube 1. That is, for laminating between each layer 22, 23, 24, the generally used cladding method such as hot rolling can be employed. The plate thickness ratio ($t_1$:$t_2$) of the high thermal expansion member 22 and the low thermal expansion member 23 is preferable to be in the range of from 55:45 to 45:55. The plate thickness $t_3$ of the intermediate member 24 is preferable to be not exceeding 80% of the total plate thickness T. The reasons for providing these are as mentioned above. Further, even for the thermal deformation member for an electric current control 21, various types of modifications can be employed as identical as the case of the thermal deformation member for an electron tube 1.

For the high thermal expansion member 22, the low thermal expansion member 23 and the intermediate member 24, basically, the identical materials as for the thermal deformation member for an electron tube 1 can be employed. However, for the high thermal expansion member 22, without limiting to the Fe—Ni—Cr based alloy, an Fe—Ni—Mn based alloy can be used. The Fe—Ni—Mn based alloy possesses high thermal expansion coefficient identical as that of the Fe—Ni—Cr based alloy. As an Fe—Ni—(Cr, Mn) based alloy for the high thermal expansion member 22, an alloy comprising from 15 to 30 weight % of Ni and from 2 to 10 weight % of at least one member selected from Cr and Mn, and the balance essentially consisting of Fe can be cited. When the content of Ni and (Cr, Mn) goes outside the above described range, any case can leads to deterioration of the thermal expansion coefficient.

For the low thermal expansion member 23, as identical as the thermal deformation member for an electron tube 1, an Fe—Ni based alloy comprising from 30 to 50 weight % of Ni and the balance essentially consisting of Fe is preferred. For the intermediate member 24, one kind of metal selected from Fe, Al and Cu, which are all excellent in their workability and less expensive than the constitutional materials of the above described high thermal expansion member 22 or low thermal expansion member 23, or an alloy including these metals can be employed preferably. In particular, Fe, Al or an alloy based on these metals and the steel material (for example, SS 400) are preferable as the constitutional material of the intermediate member 24. The specific thermal deformation of the thermal deformation member for an electric current control 21 which uses these materials is as described above.

In the thermal deformation member for an electric current control 21, as identical as the above described thermal deformation member for an electron tube 1, while attaining the thermal bent curvature nearly identical as that of the conventional bimetal, the plate thicknesses $t_1$, $t_2$ of the high thermal expansion member 22 and the low thermal expansion member 23 can be diminished by the thickness $t_3$ of the intermediate member 24. That is, the total plate thickness T, which influences the predetermined thermal bent curvature and strength or the long term reliability, can be obtained while diminishing the plate thicknesses $t_1$, $t_2$ of the high thermal expansion member 22 and the low thermal expansion member 23. Therefore, when, for the high thermal expansion member 22 and the low thermal expansion member 23, the Fe—Ni—(Cr,Mn) based alloy or the Fe—Ni based alloy, which are expensive in their manufacturing cost and less excellent in their workability, is employed, by disposing an intermediate member 24 excellent in its workability and less expensive than the above described alloys, while attaining the predetermined thermal bent curvature, the manufacturing cost of the thermal deformation member for an electric current control 21 can be reduced as a whole. Further, the workability of the thermal deformation member for an electric current control 21 can be enhanced.

The thermal deformation member for an electric current control 21 of the present invention can be preferably employed in a thermal deformation member (bimetal) of an overcurrent protection such as a molded-case circuit-breaker or a thermal overload relay. Further, other than these devices, it can be applied in an electric current control which controls (for example, breaks) electric current by deformation based on resistance heating (Joule heat) of the thermal deformation member for an electric current control 21 itself when load current flows through the thermal deformation member for an electric current control 21 and overcurrent such as overload current or short-circuit current flows. The deformation of the thermal deformation member for an electric current control 21 may depends on the heat of a resistor (heater) in which the load current flows.

Next, one embodiment of a molded-case circuit-breaker in which an overcurrent protection of the present invention is employed will be described with reference to FIG. 6.

Figure 6:
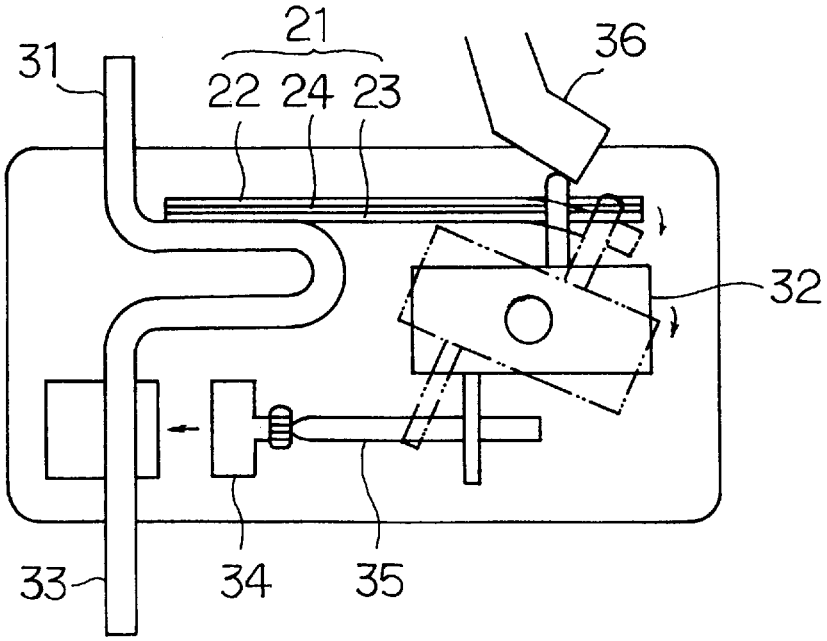
FIG. 6 is a diagram showing an essential construction of an overcurrent protection according to one embodiment of the present invention.

FIG. 6 is a diagram showing an outline construction of the molded-case circuit-breaker of one embodiment in which an overcurrent protection of the present invention is applied. In the figure, numeral 31 is a heater. The heater 31 is connected to wiring so as for the load current to flow in. In the neighborhood of the heater 31, as a thermal deformation member, a thermal deformation member for electric current control 21 of the present invention which is explained in the above described embodiment is disposed making a contact.

The thermal deformation member for an electric current control 21 is fixed to a trip bar 32 which is made possible to rotate by a central axis. The trip bar 32 is, further, connected to a supporting bar 35 of an armature 34 disposed in an opposed manner to a fixed iron-core 33. The armature 34 is constituted in such a manner that it opens or closes a contact point not shown in the figure according to its movement. Numeral 36 in the figure is a latch 23.

The thermal deformation member for an electric current control 21 is disposed in such a manner that the high thermal expansion member 22 is placed on the trip bar 32 side and the low thermal expansion member 23 is placed on the latch 36 side through the intermediate member 24. The trip bar 32 is constructed to rotate by the thermal deformation of the thermal deformation member for an electric current control 21. Accompanying the rotation of the trip bar 32, the armature 34 moves towards the fixed iron-core 33.

In such a molded-case circuit-breaker, when the load current which flows the heater 31 is within the rating, the thermal deformation member for an electric current control 21 maintains its normal shape. Therefore, the contact point which is opened or closed by the armature 34 is closed. Besides, if the overload current or short-circuit current occurs on the loading side and overcurrent flows through the heater 31, the heater 31 is heated up to a predetermined temperature and the thermal deformation member for an electric current control 21 deforms towards the trip bar 32 side (shown in the figure with an arrow). Accompanying the deformation of the thermal deformation member for an electric current control 21, the trip bar 32 rotates, further the armature 34 moves towards the fixed iron-core 33 side, thereby the contact point not shown in the figure is opened. That is, circuit is broken and the load is protected from the overcurrent.

A circuit breaking function according to the molded-case circuit-breaker of the above described embodiment, as explained in the above described embodiment, is materialized by the thermal deformation member for an electric current control 21 of the present invention which is less expensive than the conventional bimetal and excellent in its workability and secures the total plate thickness which influences strength or long term reliability. Therefore, in addition to realization of the reduction of the manufacturing cost of the molded-case circuit-breaker, reliability of the molded-case circuit-breaker can be enhanced accompanying the improvement of the workability.

The above described embodiment is a molded-case circuit-breaker in which overcurrent flows through the heater 31. The overcurrent protection of the present invention can be applied, not limiting in this, in various types of overcurrent protections such as a molded-case circuit-breaker in which load current directly flows through the thermal deformation member for an electric current control 21, and a thermal overload relay in which overcurrent flows through the heater or the thermal deformation member for an electric current control.

INDUSTRIAL APPLICABILITY

As evident from the above described embodiments, a thermal deformation member for an electron tube and a thermal deformation member for an electric current control of the present invention have, in addition to low cost and excellent workability, excellent strength or long term reliability. Therefore, they are effective as a thermal deformation member of a color picture tube or an overcurrent protection. According to a color picture tube of the present invention in which the thermal deformation member of the present invention is employed as a part of a frame holder, while realizing low cost, excellent color reproduction property or reliability can be materialized. According to an overcurrent protection in which the thermal deformation member of the present invention is employed, while maintaining excellent overcurrent protection function, cost reduction can be materialized.

What is claimed is:

1. A thermal deformation member for an electron tube, comprising:

a high thermal expansion member composed of an Fe—Ni—Cr based alloy;

a low thermal expansion member composed of an Fe—Ni based alloy; and an intermediary member which is interposed between the high thermal expansion member and the low thermal expansion member and is substantially composed of one kind of metal selected from a group of Fe, Al and Cu, wherein the high thermal expansion member, the low thermal expansion member, and the intermediary member are laminated.

2. The thermal deformation member for an electron tube as set forth in claim 1:

wherein, when a thermal expansion coefficient of the high thermal expansion member is $\alpha_1$ and a thermal expansion coefficient of the low thermal expansion member is $\alpha_2$, the intermediary member possesses a thermal expansion coefficient $\alpha_3$ which satisfies $\alpha_1>\alpha_3>\alpha_2$.

3. The thermal deformation member for an electron tube as set forth in claim 1:

wherein the intermediary member is substantially composed of Fe.

4. The thermal deformation member for an electron tube as set forth in claim 3:

wherein the intermediary member consists of 0.3 weight % or less of C, 0.05 weight % or less of P, 0.05 weight % or less of S, and the balance of Fe and inevitable impurities.

5. The thermal deformation member for an electron tube as set forth in claim 1:

wherein plate thickness ratio between the high thermal expansion member and the low thermal expansion member is in the range from 55:45 to 45:55 and the plate thickness of the intermediary member does not exceed 80% of the total plate thickness of the thermal deformation member.

6. The thermal deformation member for an electron tube as set forth in claim 1:

wherein the Fe—Ni—Cr based alloy consists essentially of from 15 to 30 weight % of Ni and from 2 to 10 weight % of Cr, and the balance of Fe, and the Fe—Ni based alloy consists essentially of from 30 to 50 weight % of Ni and the balance of Fe.

7. The thermal deformation member for an electron tube as set forth in claim 1:

wherein the high thermal expansion member, the low thermal expansion member, and the intermediary member are joined together by hot rolling.

8. A thermal deformation member for an electric current control, comprising:

a high thermal expansion member composed of an Fe—Ni—(Cr, Mn) based alloy;

a low thermal expansion member composed of an Fe—Ni based alloy; and an intermediary member which is interposed between the high thermal expansion member and the low thermal expansion member and is substantially composed of one kind of metal selected from Fe, Al and Cu, wherein the high thermal expansion member, the low thermal expansion member, and the intermediary member are laminated.

9. The thermal deformation member for an electric current control as set forth in claim 8:

wherein, when a thermal expansion coefficient of the high thermal expansion member is $\alpha_1$ and a thermal expansion coefficient of the low thermal expansion member is $\alpha_2$, the intermediary member possesses a thermal expansion coefficient $\alpha_3$ which satisfies $\alpha_1>\alpha_3>\alpha_2$.

10. The thermal deformation member for an electric current control as set forth in claim 8:

wherein the intermediary member is substantially composed of Fe.

11. The thermal deformation member for an electric current control as set forth in claim 10:

wherein the intermediary member consists of 0.3 weight % or less of C, 0.05 weight % or less of P, 0.05 weight % or less of S, and the balance of Fe and inevitable impurities.

12. The thermal deformation member for an electric current control as set forth in claim 8:

wherein plate thickness ratio between the high thermal expansion member and the low thermal expansion member is in the range from 55:45 to 45:55 and the plate thickness of the intermediary member does not exceed 80% of the total plate thickness of the thermal deformation member.

13. The thermal deformation member for an electric current control as set forth in claim 8:

wherein the Fe—Ni—(Cr, Mn) based alloy consists essentially of from 15 to 30 weight % of Ni and from 2 to 10 weight % of at least kind selected from Cr and Mn, and the balance of Fe, and the Fe—Ni based alloy consists essentially of from 30 to 50 weight % of Ni and the balance of Fe.

14. An overcurrent protection, comprising:

a thermal deformation portion composed of the thermal deformation member for an electric current control as set forth in claim 8 which, when overcurrent flows, deforms due to its own Joule heat or heat of resistor disposed in contact therewith; and a contact point which opens a circuit according to deformation of the thermal deformation portion.

15. The thermal deformation member for an electric current control as set forth in claim 8:

wherein the high thermal expansion member, the low thermal expansion member, and the intermediary member are joined together by hot rolling.

* * * * *